US007490507B2

(12) United States Patent
La Rosa et al.

(10) Patent No.: US 7,490,507 B2
(45) Date of Patent: Feb. 17, 2009

(54) METHOD FOR DETERMINING THE MOVEMENT OF A BLAST MOVEMENT MONITOR AND ASSOCIATED ROCK AS A RESULT OF BLASTING OPERATIONS

(75) Inventors: David Mario La Rosa, Bellbowrie (AU); Darren Mark Thornton, Bellbowrie (AU); Michael Wortley, Bellbowrie (AU)

(73) Assignee: University of Queensland, Queensland (AU)

( * ) Notice: Subject to any disclaimer, the term of this patent is extended or adjusted under 35 U.S.C. 154(b) by 0 days.

(21) Appl. No.: 11/601,283

(22) Filed: Nov. 17, 2006

(65) Prior Publication Data

US 2007/0151471 A1 Jul. 5, 2007

Related U.S. Application Data

(62) Division of application No. 10/854,905, filed on May 27, 2004, now Pat. No. 7,367,269.

(30) Foreign Application Priority Data

May 27, 2003 (AU) ..... 2003902609

(51) Int. Cl.
*G01N 33/22* (2006.01)

(52) U.S. Cl. ..... 73/35.14

(58) Field of Classification Search ..... 73/35.14; 102/301

See application file for complete search history.

(56) References Cited

U.S. PATENT DOCUMENTS 4,602,215 A 7/1986 Ryaboshtan et al.
5,430,953 A * 7/1995 de Souza ..... 33/787
2003/0001775 A1* 1/2003 Turner ..... 342/357.07

FOREIGN PATENT DOCUMENTS

| | | |
|---|---|---|
| DE | 3 317 787 | 11/1984 |
| RU | 2 098 845 C1 | 12/1997 |
| SU | 585287 A | 12/1977 |
| SU | 1257597 A | 9/1986 |

OTHER PUBLICATIONS

International-Type Search Report, Australian Patent Office, Date of request: Jan. 14, 2004.

* cited by examiner

*Primary Examiner*—Paul M. West
*Assistant Examiner*—John Fitzgerald
(74) *Attorney, Agent, or Firm*—Alix, Yale & Ristas, LLP

(57) ABSTRACT

A method for measuring the movement of boundaries between different portions of a heterogeneous rock body is disclosed. The method comprises placing a plurality of blast movement monitors 109 in a rock body prior to blasting and noting the position of each blast movement monitor. The rock body is then blasted to break it up into a plurality of pieces. Thereafter the position of the blast movement monitors 109 is located and based on this the boundaries of rock portions can be adjusted to account for the blast. This leads to a more accurate reporting of different ore bodies to the appropriate processor in a heterogeneous rock body. An apparatus for carrying out the method is also disclosed. The apparatus comprises broadly a said monitor 109 and a receiver. The monitor 1 comprises a transmitter 109 received within a casing 111 that in turn is received within a housing 126. Further the casing 111 can move within the housing 126 and self right so that it always transmits its signal in an upright direction.

23 Claims, 10 Drawing Sheets

METHOD FOR DETERMINING THE MOVEMENT OF A BLAST MOVEMENT MONITOR AND ASSOCIATED ROCK AS A RESULT OF BLASTING OPERATIONS

CROSS REFERENCE TO RELATED APPLICATIONS

This application is a divisional of and claims priority of U.S. patent application Ser. No. 10/854,905 filed May 27, 2004 now U.S. Pat. No. 7,367,269.

TECHNICAL FIELD

This disclosure relates to a method for determining the movement of a blast movement monitor placed within a rock body as a result of blasting of the rock. This disclosure also extends to a blast movement monitor and apparatus for use in performing the method. This disclosure also extends to a method of determining the movement in a boundary between two different rock or ore positions in a heterogeneous rock body.

This disclosure relates particularly but not exclusively to a method of determining the movement of an ore boundary. Typically the boundary might be between high grade ore, e.g. a vein of gold ore, and a low grade ore, in a heterogeneous ore body of an open cast mine that practices open cut selective mining. It will therefore be convenient to hereinafter describe the embodiments with reference to this example application. However it is to be clearly understood that the disclosure is capable of broader application. For example it may be used to determine the movement in boundaries between ore and waste for many ores. It may also be used to measure the boundary movement between sulphide ore and oxide ore in fractional deposits. These ores require different concentration processes and therefore need to be recovered separately. It may also be used to measure the movement of the edge of a coal seam when the overburden is blasted.

BACKGROUND

Open cast mining operations are well known and are conducted in a number of countries around the world. Typically they comprise progressively mining domains of an ore body in a staged batch-like process. Each so called batch comprises selectively placing explosives in the rock of the batch. Thereafter the rock is blasted to break and loosen the rock and form a muck pile. Typically the deposits in these mines are heterogeneous in the sense that the ore is disseminated in complex shaped volumes of varying grade within a host rock which is waste. The shape of each ore zone on a horizontal plane is represented by a polygon when viewed in plan.

The rock body for example might comprise one or more ore polygons that are economic to recover and waste rock that is to be discarded. The ore is selectively removed from the muck pile and sent to a concentrator where the valuable mineral is extracted by an appropriate technique. Similarly the waste rock is removed and sent to a discard rock dump. Clearly an important part of this process is the accurate delineation of and identification of the boundaries between high grade ore and low grade ore and between ore and waste. A mixture of scientific know how, geology, computer modelling, and experience is used to determine the boundaries in the body of rock prior to blasting being conducted. This art has developed to the point where mining engineers and geologists have a good three dimensional picture of the boundaries between the different ores in the virgin rock prior to blasting.

However it is quite clear that the rock moves when it is subjected to blasting. The blasting causes some expansion of the rock and in addition there may be some differences in the amount of movement of the different parts of the rock. This is illustrated schematically in FIG. 1. Currently there are no satisfactory techniques for measuring or modelling this movement in the rock and thereby also the ore boundaries as a result of the blasting operations. Mining engineers and geologists sometimes work on the assumption that the ore boundaries of the blasted rock are the same as that for the unblasted rock and direct the broken rock to respectively the concentrator and the dump on this basis.

The problem is that it is clear that the rock and therefore also the ore boundaries do move. Accordingly if this movement is not accounted for by the mining engineers in the mining operation some of the ore is directed to the dump. This leads to a loss of product which is intended to be recovered. Similarly some of the waste is recovered in the ore stream and is sent to the concentrator. This can lead to a significant loss of efficiency in the concentrators as it processes more waste and less product. This can lead to a drop off in the volume of concentrate produced per unit time.

It is universally recognized that this approach is unsatisfactory. It would therefore be highly desirable if a way could be devised of measuring the movement of the rock and thereby the ore boundaries. It would enable a three dimensional picture of the ore boundaries in the pre-blast rock body to be adjusted to account for the measured rock movement. This in turn would improve the correct reporting of the ore to the concentrator and the waste to the dump.

SUMMARY

According to one aspect there is provided a method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting.

The step of locating the position of at least one movement monitor may comprise locating the position of the monitor in three dimensional space. That is locating its position in three dimensions instead of two.

The signal may be an electro-magnetic signal having a specific frequency, e.g. a low frequency signal. The signal that is measured may be a magnetic field component of an electromagnetic field and the frequency of the signal may be in the range of 1-300 kHz. Preferably the signal is 10-200 kHz, more preferably 20-150 kHz, even more preferably 30-80 kHz, and most preferably about 66 kHz.

A low frequency signal is preferred because it is attenuated to a lesser extent by the surrounding rock than a high frequency signal.

The monitor may include a transmitter for transmitting the signal and the external communication device may include a detector or receiver for detecting the signal from the transmitter.

Thus the signal is transmitted from the monitor to the detector.

The detector may sense the magnetic component of the electro-magnetic field generated by the transmitter and also the strength of the magnetic field at that particular point.

The transmitter may be received within a casing which in turn is received within a housing with the casing being movable relative to the housing within the housing.

Each blast movement monitor may have means for enabling the transmitter to orientate in a certain direction after the blast so that all monitors are consistent in the direction in which they emit their signal.

The orientating means may comprise self righting means wherein the transmitter in each monitor is able to return itself to an upright position after the blast so as to transmit its signal in a substantially vertically upward direction.

The self righting means may comprise forming the casing with an asymmetric weight distribution with its center of weight positioned directly beneath the geometric center of the casing. This is achieved by having a preponderance of mass in a lower half of the casing so as to cause the monitor to tend to revert to its upright position if it is moved out of its upright position. The preponderance of mass in the lower half may be assisted by having the transmitter housed more in the upper half than the lower half with more solid casing material in the lower half than the upper half. It may also be assisted by designing the transmitter to have its center of mass as low as possible.

The detector may be used to locate the XY position of the monitor on an imaginary XY plane extending broadly parallel to the surface by locating the point on the surface of the muck pile where the magnetic field signal is at its greatest. This really amounts to locating the position on the surface beneath which the monitor is located. The situation of the monitor on an imaginary XY plane or top plan view of the site can be established to an accuracy of less than one meter.

The vertical depth of the monitor within the muck pile can be gauged by measuring the strength of the magnetic field at the point on the surface where the magnetic field signal is at its greatest. The strength of the magnetic field on the surface is a function of the depth of the monitor. As a general rule the intensity of the magnetic field decays as a function of the cube of the distance from the source.

In a preferred form, the monitor can be detected up to a depth of 15 meters on an imaginary Z axis.

Instead or in addition the vertical depth of the monitor within the muck pile can be gauged by measuring the angle of the magnetic field sensed by the detector.

The general principle behind this is that the angle at which magnetic field lines cut the surface of the rock can be used to locate the source of the magnetic field. Generally the angle of the magnetic field lines relative to an imaginary horizontal line on the surface is measured.

Thus the method can be used to measure the movement of the monitor in the muck pile in three dimensions. That is its movement on an imaginary XY plane and also movement in its depth that is in a mutually orthogonal Z axis.

A plurality of said movement monitors may be placed within the rock body spaced apart from each other within the rock body. The monitors may be positioned 0 to 15 m beneath the surface of the rock body. Preferably each monitor may be positioned 1 to 10 m beneath the surface of the rock body. More preferably the monitors may be positioned at approximately half the depth of a bench of the rock body.

Conveniently each monitor may be placed within a hole, e.g. a drill hole, within the rock. Further each drill hole may be filled up with drill cuttings once the monitor has been placed in the hole.

According to another aspect there is provided a blast movement monitor for measuring the movement of rock within a rock body as a result of a blasting operation, the monitor comprising:

a monitor body defining an interior space;

an internal communicating device that is received within the interior space of the monitor body for either transmitting a signal outwardly to an external communication device or being able to detect a signal transmitted inwardly by the external communication device; and a housing having an inner surface defining an interior chamber within which the monitor body is received, the monitor body being capable of movement relative to the housing within the housing.

The internal communicating device may transmit a signal outwardly rather than receiving a signal inwardly. In this configuration the internal communicating device includes a transmitter for transmitting said signal.

The transmitter may generate an electro-magnetic field that transmits a signal at a particular frequency. Conveniently the transmitter may comprise an electric coil coupled to an electrical supply through which electrical current can be passed to generate an electro-magnetic field.

Instead the signal may be a microwave signal.

The monitor body may comprise a casing made of a non conductive material. The casing may be configured such that it can be moved in all directions across the internal surface of the housing. The internal surface of the housing may be complementary to the casing such that the casing can slide over the internal surface of the housing. Preferably the surface of the casing is curved.

In one preferred form the casing is spherical. However it is not limited to a spherical configuration.

It is obviously desirable that the casing be reasonably robust as it has to withstand blasting of the rock. At the same time it needs to be reasonably light so that it can be moved around and preferably carried around. Nylon, polyethylene and polystyrene have been found to have these properties.

Thus the surface of the casing is deliberately chosen so that it can slide over the internal surface of the housing in all directions. That is it is capable of universal movement like a ball and a socket joint. It is not limited to movement in a single plane like a hinge joint.

The housing may contain a liquid intermediate the casing and the internal surface of the housing to lubricate movement of the casing relative to the housing. The casing floats in the liquid and this assists its movement relative to the housing. The liquid may be water or oil. The arrangement may be analogous to that of a floating gimbal.

The casing and transmitter assembly is designed to have a density that is very close to that of the liquid within which it is immersed. Ideally it has a density that is the same as the liquid within which it is immersed. When this occurs it has zero weight in the liquid and a neutral buoyancy and the casing floats in the liquid. This assists in reducing friction between the casing and the internal wall. This is important to enable the casing and transmitter to self right after each blast.

In addition the liquid may serve to damp energy from the blast and thereby reduce the risk of damage to the transmitter.

The casing in turn may comprise two casing halves in the form of hemispheres that are releasably attached to each other. The casing may further include fastening elements for securely attaching the two halves to each other. The fastening elements may be in the form of bolts with screws, for securely attaching the two halves to each other. The casing may be opened up to provide access to the transmitter for checking, maintenance or replacement of components of the transmitter.

In turn the housing may comprise two parts releasably attached to each other to enable the housing to be opened up when required to get access to the casing. The housing may further include fastening elements for securely attaching the two housing parts together. The housing may have a cylindrical configuration and be made from a plastics or nylon material.

The monitor may further include a cover within which the housing is received. The cover may be spaced outwardly away from the external surface of the housing and a padding material may be placed between the cover and the housing. The purpose of the padding is to help damp and/or absorb the energy of the blast before it reaches the transmitter. The padding material may be a foam material, e.g. a low density foam.

Conveniently the cover may be made of plastics material and may have a circular cylindrical configuration.

According to yet another aspect there is provided an apparatus for determining the movement of boundaries between different portions of a heterogeneous rock body as a result of a blast, the apparatus comprising:

at least one blast movement monitor as described above according to the preceding aspect; and an external communication device for communicating with the blast movement monitor.

The blast movement monitor may include any one or more of the optional features described above for the second aspect. Specifically each monitor may include a transmitter for transmitting signals outwardly.

The external communication device may be a detector or receiver for detecting signals from a transmitter in the blast movement monitor. The detector or receiver may include an antenna.

The detector may be capable of detecting the magnetic component of an electromagnetic field. The detector may be a magnetic coil tuned to the same frequency as the transmitter thereby to receive a signal from the monitor.

The detector may further include an amplifier operatively coupled to the magnetic coil to increase the sensitivity of the detector.

Conveniently the detector may be hand held and in use it will be carried by an operator moving across the surface of the blasted rock body.

According to yet another aspect there is provided a method of determining the movement of boundaries between different portions of a heterogeneous rock body as a result of a blast, the method comprising the following steps:

placing at least one blast movement monitor as described in the second aspect above in a rock body prior to blasting and noting the position of the/each blast movement monitor;

blasting the rock body to break up the rock body into a plurality of rock pieces;

locating the position of at least one blast movement monitor as a result of the blast;

determining the movement of the rock in the region of at least one blast movement monitor due to the blast; and adjusting the position of the boundaries between different rock portions in response to the determined movement of rock to compensate for movement caused by the blast.

The method may further include the step of providing a map of the boundaries of the different rock portions within the rock body prior to said step of adjusting the position of the boundaries.

The step of placing may comprise placing a plurality of said blast movement monitors in holes in the rock body spaced apart from each other. The step of locating may include locating the position of at least 50% of the placed monitors, preferably at least 75% of the placed monitors after the blast. The blast movement monitors may be placed in holes that are drilled in the rock body. The holes may be filled with drill cuttings once the monitor has been placed in the hole.

The holes may be spaced apart from explosives holes that are drilled in the rock body. Generally the position of the monitors will be selected by the mining engineers or geologists and will not follow a repeating pattern like the blast holes. At least some of the blast movement monitors may be placed in positions in the rock body that are on or are proximate to a boundary between different rock portions within the rock body.

The boundaries of the rock body may delineate rock portions that are a recoverable ore polygon and waste. For example the rock body may comprise a rock portion that is a polygon of high grade gold ore received within a large body of host waste rock.

The boundaries of the rock body may delineate rock portions that are high grade ore, low grade ore and waste. The high grade ore may comprise polygons of gold ore having a grade of about 5-7 g/t and the low grade ore may comprise polygons of gold ore of about 1-3 g/t that need to be recovered separately from the high grade ore.

The boundaries of the rock body may delineate rock portions that are sulphide ores, oxide ores and/or supergene ores.

The step of adjusting the position of the boundaries between the rock portions may include adjusting each said boundary based on movement of one or more monitors as a result of the blast. Preferably the step of adjusting the position of the boundaries is based on a distance weighted average of movement of a plurality of monitors located on the boundary or in proximity to the boundary.

Finally the method may further include building up an adjusted three dimensional map of the boundaries of the different rock portions based on the measured movement of the blast movement monitors as a result of the blast.

Once the adjusted boundaries have been calculated then the broken ore can be removed and transferred to the concentrator and the waste or low grade ore can be removed and sent to a dump or low grade ore treatment plant.

BRIEF DESCRIPTION OF THE DRAWINGS

A method for determining the movement of a set of blast movement monitors in a blasting operation at a mine and an apparatus including blast movement monitors for use in the method may manifest themselves in a number of forms. It will be convenient to hereinafter provide a detailed description of several embodiments with reference to the accompanying drawings. The purpose of providing this detailed description is to instruct persons having an interest in the subject matter of the disclosure how to put the disclosure into practice. It is to be clearly understood however that the specific nature of this detailed description does not supersede the generality of the preceding statements. In the drawings.

DETAILED DESCRIPTION OF THE PREFERRED EMBODIMENTS

Figure 2:
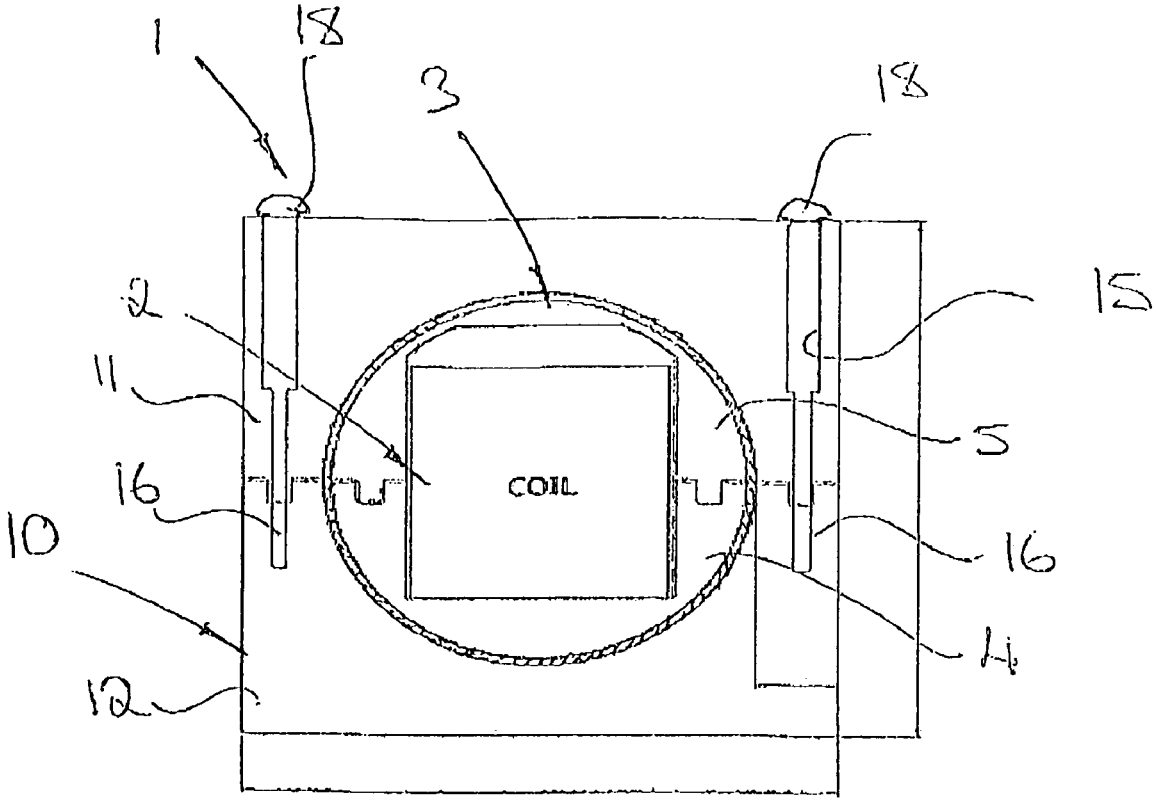
FIG. 2 is a schematic sectional view of a blast movement monitor in accordance with a first aspect.
Figure 3:
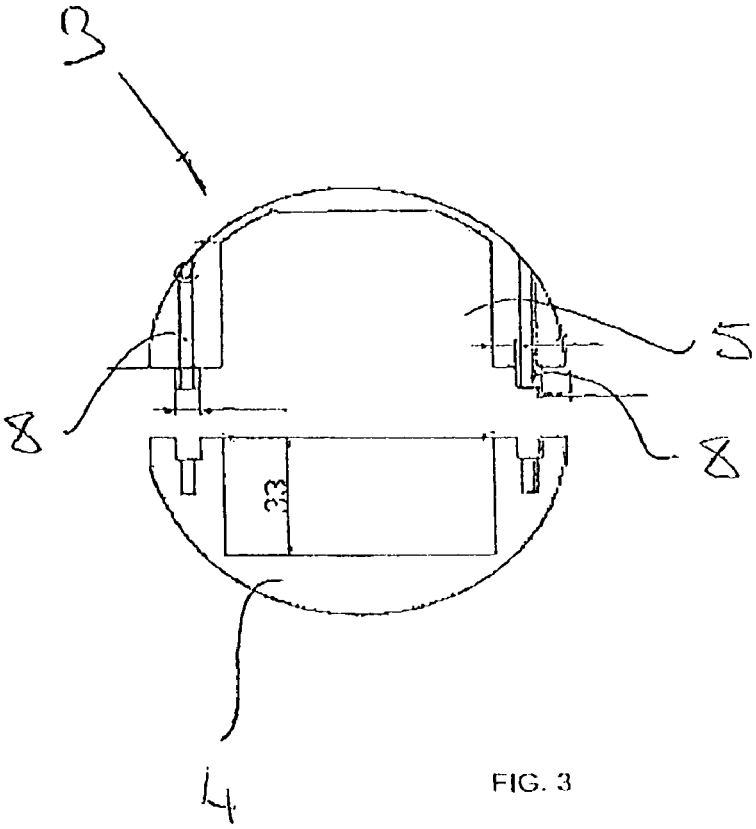
FIG. 3 is an exploded sectional front view of a casing for the monitor shown in FIG. 2.
Figure 4:
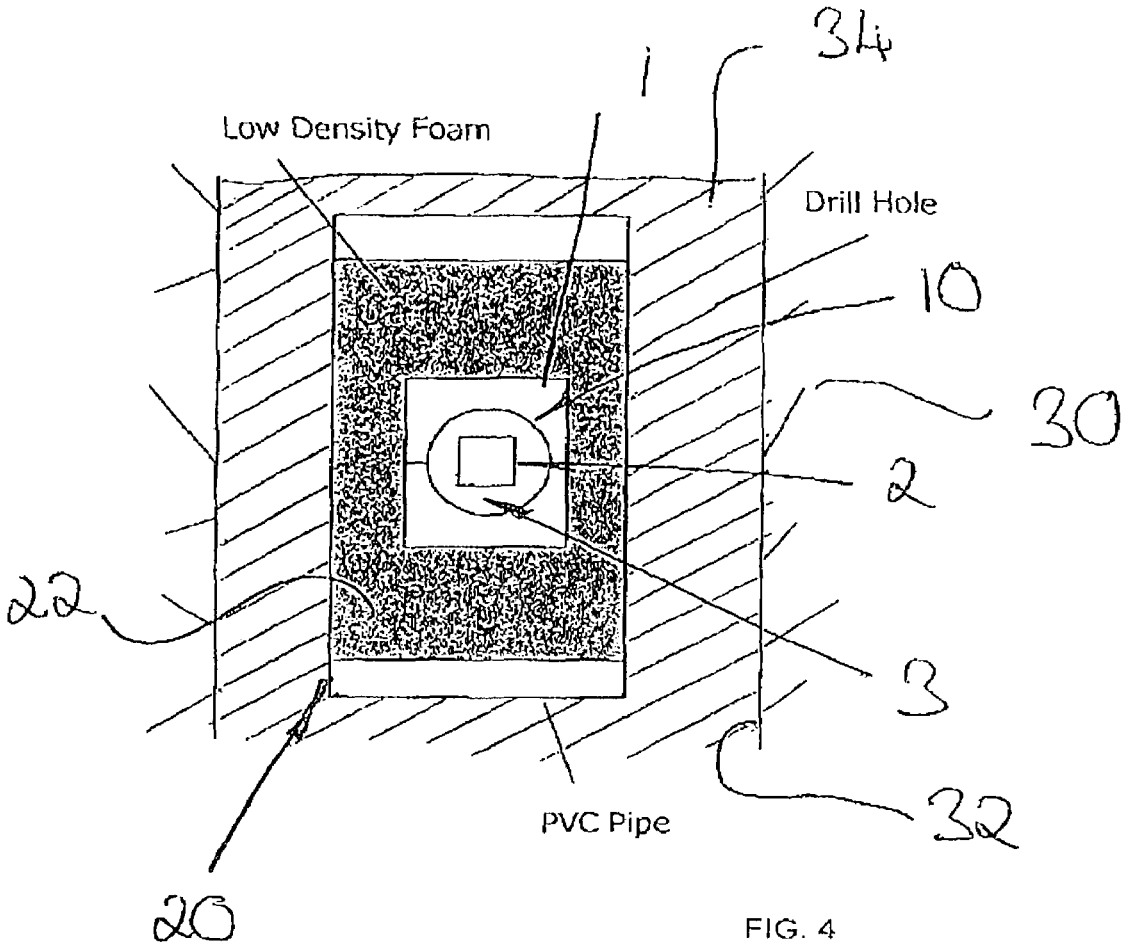
FIG. 4 is a schematic front view of the movement monitor of FIG. 2 received within a cover which is in turn received within a drill hole within a rock body about to be blasted.

In FIGS. 2 to 4 the blast movement monitor is indicated generally by the reference numeral 1.

The monitor 1 comprises broadly a communication device that is a transmitting device or transmitter 2 received within a monitor body that is in the form of a split casing 3. The casing 3 comprises two hemispherical halves 4, 5 and may conveniently be made of a material such as nylon, polyethylene, polystyrene or other engineering plastics although clearly other materials may also be used.

Figure 5:
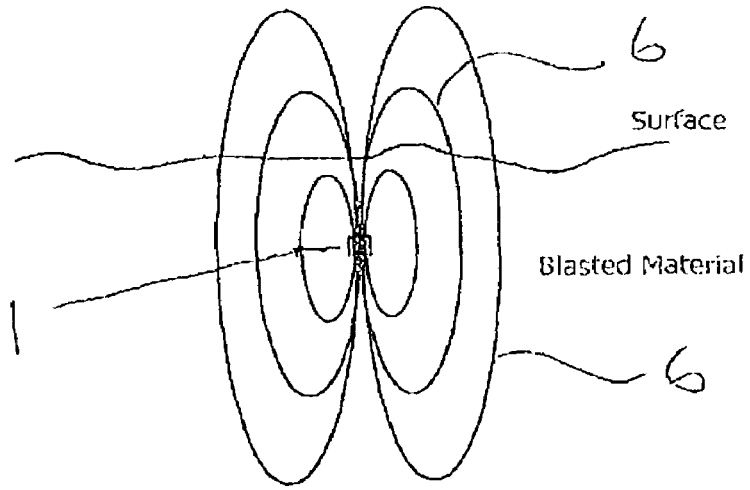
FIG. 5 is a schematic front view of a magnetic field generated by a movement monitor within the rock body showing the magnetic field lines generated by the monitor.

The transmitter 2 comprises a cylindrical coil oscillating at a suitable frequency for example 50 to 90 kHz. In the illustrated embodiment a frequency of 66 kHz was used although clearly many other frequencies could equally have been used. An advantage of using a low frequency is that it is attenuated to a lesser extent in rock. The coil is oriented vertically in the casing as shown in FIG. 2. This has the effect of generating a dipole shaped magnetic field as shown in FIG. 5 with magnetic field lines 6.

Each hemispherical half 4, 5 is generally solid but has a profiled cut away defined therein. When the two halves 4, 5 are assembled to define the casing 3 as a whole then the cut aways define an approximately cylindrical interior space within which the transmitter 2 is received. The cut away is greater in half 4 than half 5 to assist self-righting of the casing. This will be described in more detail below.

Each of the hemispherical halves 4, 5 has channels 8 defined therein through which suitable fastening elements can be passed to secure the two halves 4, 5 to each other and form the assembled casing 3.

The illustrated embodiment shows four said channels 8 that are positioned broadly towards the corners and are suited to having screws passed there through. The channels 8 pass fully through the half 5 and a short distance into the half 4. At least part of each channel within the half 4 defines an internal screw thread to engage a screw thread on the screw and thereby effect a positive attachment. In the illustrated embodiment 3 mm nylon screws (not shown) were used but this should be regarded as merely one of many different possible screws that could be used. FIGS. 2 and 3 show how the spherical casing 3 is assembled.

The transmitter 2 is mounted in the casing 3 as follows. The two halves 4, 5 are separated from each other and the transmitter 2 is placed into the lower half 4. The upper half 5 is placed in position over the lower half 4 and the two halves 4, 5 are attached together by the fastening elements.

The casing 3 is designed so that its center of mass is lower than the center of the sphere. In the illustrated embodiment this is accomplished by having a greater mass of the casing body in the lower half 4 and having this excess mass evenly distributed around the center of the casing 3. This confers on the casing 3 an ability to right itself when it is displaced out of its upright position, e.g. due to a blast. The casing 3 pivots back until the center of mass is directly below its center and it is again upright. The signal is therefore transmitted directly upwardly.

The monitor 1 also includes a housing 10 (shown in FIG. 2) within which the casing 3 is received. In the illustrated embodiment the housing 10 is cylindrical although clearly any other shape could also be used. The housing 10 may be solid and have an internal surface defining an internal chamber of complementary shape to the casing 3.

The casing 3 is received within the internal chamber in the housing 10 of complementary shape with at least a small amount of clearance. This enables the casing 3 to move in the housing 10 by sliding over the internal surface of the housing. As such it can move or rotate within the housing 10. This is an important feature of the monitor 1 as will be described in more detail below.

The chamber of the housing 10 is filled with liquid, e.g. water or silicon oil, that sits between the casing 3 and the internal surface of the housing 10. The casing assembly comprising the casing 3 and the enclosed transmitter 2 has a specific gravity that approximates very closely that of the liquid so that it floats in the liquid with close to zero weight. This is important to ensure that movement of the casing 3 within the housing 10 is not hindered by friction between the casing 3 and the housing 10. The liquid assists in lubricating the sliding surfaces of the housing 10 and the casing 3. In addition the liquid may assist in damping and absorbing energy from the blast before it reaches the transmitter 2.

The housing 10 comprises an upper part 11 and a lower part 12 each of which define hemispherical cut outs within which the assembled casing 3 is received. The upper part 11 of the housing defines four screw threaded passages 15. Similarly the lower part 12 of the housing has four screw threaded passages 16 that are aligned with the passages 15 on the upper part 11 when placed in position.

The two housing parts 11, 12 are attached to each other by mounting the upper part 11 on the lower part 12 and then passing screws 18 through the passages or screw channels 15 in the upper part 11 and through into the passages or receiving channels 16 in the lower part 12.

Optionally a cover 20 may be mounted over the housing 10 as shown in FIG. 4. The cover 20 may conveniently comprise a section of PVC pipe having a diameter somewhat greater than that of the housing 10. The space between the housing 10 and the cover 20 can be filled with a material 22 for damping the force of the blast. This material 22 might be low density foam.

The foam 22 in the cover 20 acts to reduce the force of the blast reaching the transmitter 2 as follows. When a shock wave, e.g. from a blast, reaches an interface of different materials, the amount of energy that crosses the interface decreases proportionately to the difference in density of the two media. The foam 22 has a substantially lower density than rock and consequently when the shock wave moves into the foam a large amount of energy is dissipated and this energy does not reach the transmitter 2.

An apparatus for use with the monitors also includes a detector or receiver (not shown) for detecting the signal from the monitor. In essence the detector is a hand held device that has a wire coil for sensing a magnetic field and an amplifier for amplifying the detected signal to assist in measuring its strength. The detector enables a user to locate the point on the surface of the broken rock beneath which the monitor is located. The detector also enables the approximate depth of the monitor beneath the surface to be determined.

Figure 10:
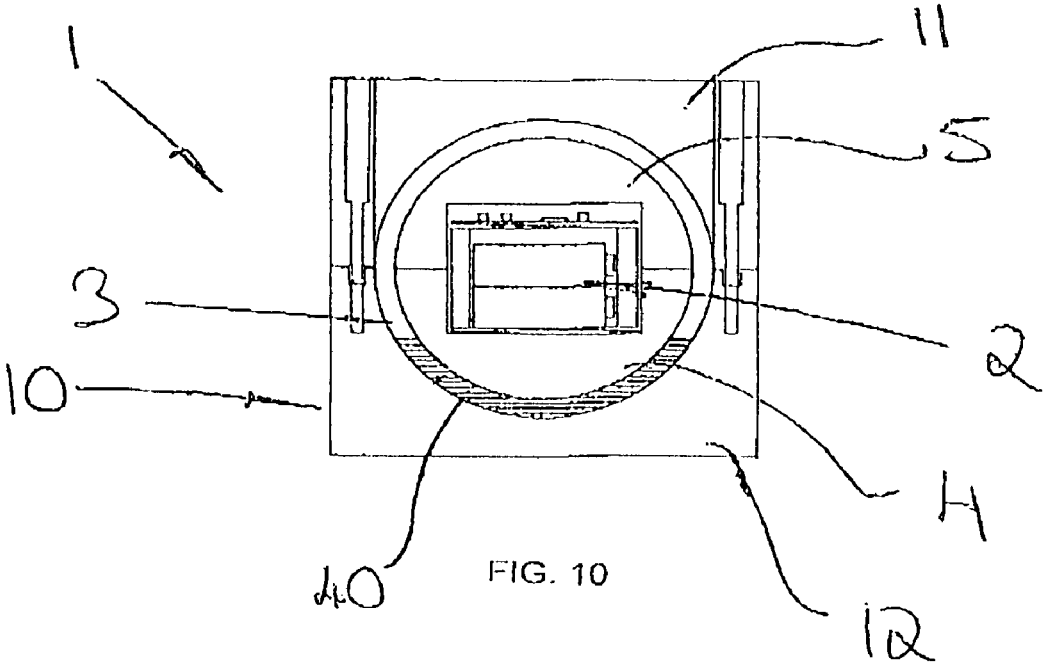
FIG. 10 is a schematic cross sectional front view of a monitor in accordance with a second embodiment.
Figure 11:
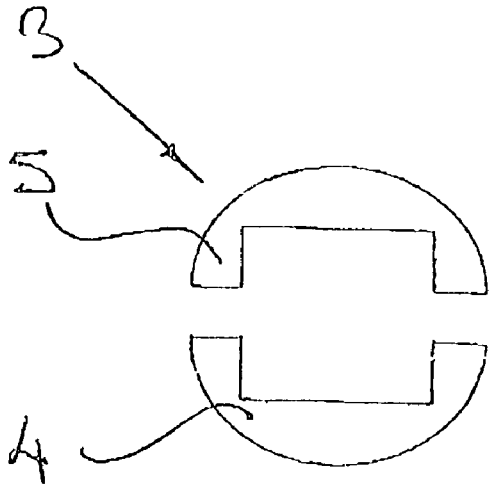
FIG. 11 is an exploded view of a casing for the monitor of FIG. 10.
Figure 12:
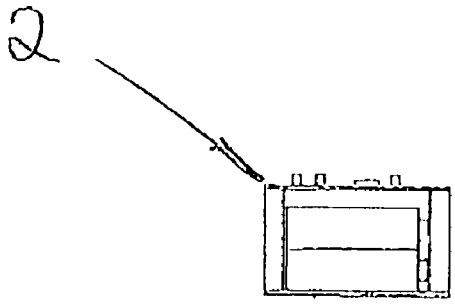
FIG. 12 is a front view of a transmitter for the monitor of FIG. 10.

FIGS. 10 to 12 illustrate a monitor in accordance with a second embodiment.

The monitor 1 is structurally and functionally very similar to the monitor illustrated in FIG. 2 to 4. Accordingly unless otherwise indicated the same reference numerals will be used to refer to the same components.

The following description will focus on the major differences between this embodiment and the earlier embodiment.

Figure 1:
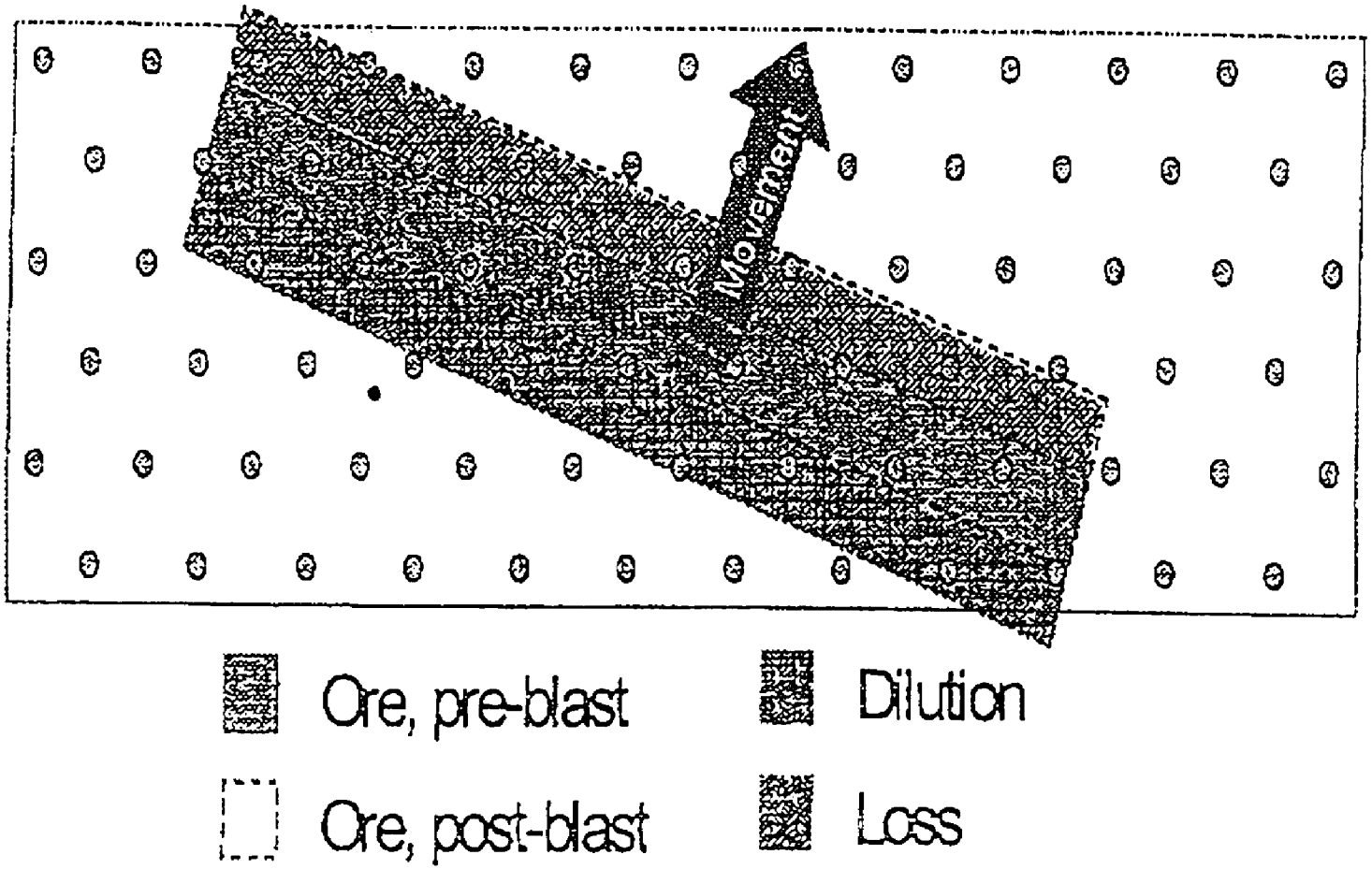
FIG. 1 indicates schematically in plan view a likely movement of a rock body as a result of blasting.

The transmitter 2 comprises a coil with a battery mounted within the coil. This coil has a more compact shape than the coil of the FIG. 1 embodiment.

The transmitter 2 is snugly received within complementary cut outs in the casing halves 4, 5 and the casing 3 is then in turn received within a spherical chamber defined in the housing 10.

The casing 3 is received within the chamber with some clearance and the casing floats in a pool of liquid which is oil 40 within the chamber. As described above the oil lubricates the casing relative to the housing and also damps the shock of the blast.

Figure 14:
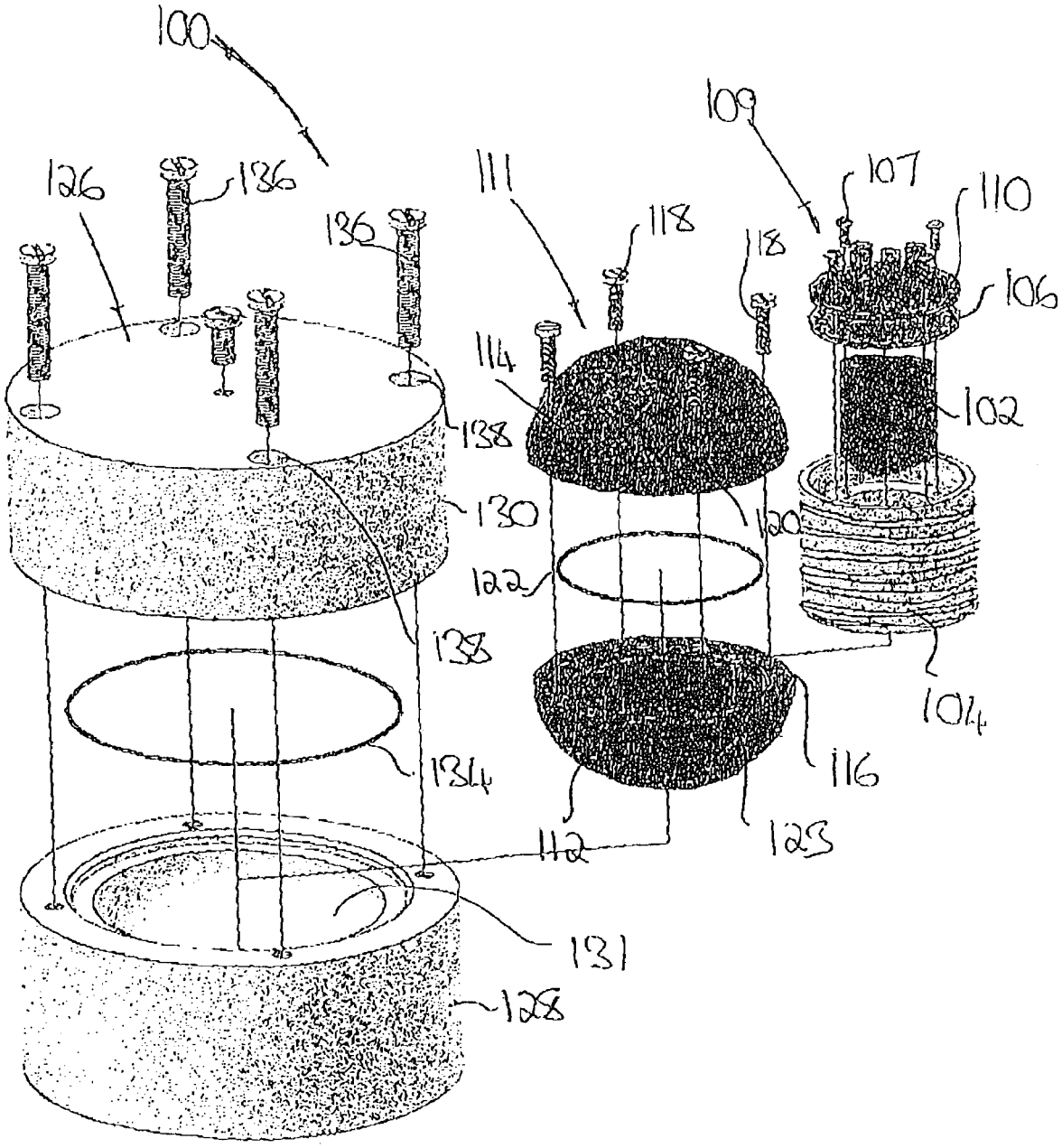
FIG. 14 is an exploded view of a movement monitor in accordance with a third embodiment.

FIG. 14 illustrates a monitor in accordance with a third embodiment. While this monitor is substantially more different from the first embodiment than the second embodiment, it does still have many structural and functional similarities. Accordingly the description below is to be read together with that for the FIG. 2 embodiment.

Broadly the monitor 100 comprises a casing 111 with a transmitter 109 received within the casing 111. The casing in turn is in turn housed within a housing 126.

We now discuss each of these components in more detail in turn.

The transmitter 109 comprises a battery pack 102 received within a coil former and associated coil 104. A gasket 106 is mounted over an end of the battery pack 102 and the coil 104. A printed circuit board 110 in turn is mounted over the gasket 106 on the side remote from the coil 104.

In the illustrated embodiment, the gasket 106, printing circuit board 108 and the coil former and coil 104 are all assembled together as a separate sub-unit by means of fastening elements 107 which are passed through aligned apertures on each of the printed circuit boards 110, gasket 106 and coil 104.

The casing 111 has a substantially spherical configuration and is made up of upper and lower hemispherical halves 114, 112 that are attached to each other. The hemispheres 114, 112 while being fairly solid define an interior space within which the transmitter subunit 109 is received with some small clearance. The cut-out in the upper half 114 is much greater than that in the lower half 112. As a result more weight remains in the lower half. This assists the self-righting property of the casing 111.

The illustrated casing halves 114, 112 are made of polyethylene which is reasonably solid and robust and non-conductive without being too heavy. Nylon has also been found to be suitable for the casing but clearly many other materials could also be used.

The casing 111 further includes a sealing O-ring 122 between the upper and lower halves 114, 112. In the illustrated embodiment an O-ring of the type BS039 sits in a 45 degree chamfer 116 defined in the rim of the lower half 112. This O-ring has been found to be very efficacious in performing the function of sealing the two halves 114, 112 when assembled. This prevents water from entering the casing 111. If this occurs, the self-righting mechanism will fail. Protecting the electronics is a secondary function of the O-ring.

The two halves 114, 112 are connected together by four screws 118 passing through complementary passageways 120, 123 in each of the halves much like the FIG. 2 embodiment.

The housing 126 comprises a circular cylindrical body having closed ends. As with the casing the housing 126 can be opened up into upper and lower halves 130, 128. Each said half has an internal surface 131 defining a hemispherical chamber that is complementary to the casing 111 and within which the casing 111 is received with a small amount of clearance.

The housing 126 is solid apart from the hemispherical cut-outs and is of solid construction. The halves are assembled by four bolts 136 that are passed through passageways 138 in the upper half 130 and down into passageways 142 in the lower half 128. Further another sealing O-ring 134 of the same general type as that used on the casing is positioned between the upper and lower halves 130, 128. The illustrated housing is made of nylon but clearly other engineering plastics materials could be used.

The casing 3 floats in the liquid as described above for the FIG. 2 embodiment. This is important to facilitate free movement of the casing within the housing. Thus the space between the casing and the internal surface of the housing is virtually completely full of water.

The short screw in the center of the upper housing 130 is a filler plug. Once everything is assembled 100, liquid which is water is injected through the said hole until the internal chamber is completely filled. The screw (un-numbered) is then inserted to seal the hole.

When fully assembled with the transmitter 101 within the casing 111 and the casing within the housing 126 the monitor 100 forms a neat compact body of solid construction that is portable.

In use a plurality of monitors 1 are placed in holes in a rock body 30, spaced apart from each other and from the explosives.

As shown in FIG. 4 each monitor 1 may be placed in a drill hole 32 in the rock body 30 when the rock body is prepared for blasting. Typically the monitor 1 is packed and buried under drill cuttings 34. Optionally the monitor 1 includes a cover 20 of PVC pipe covering the housing 10. The embodiment illustrated in FIG. 4 shows such a cover.

After the placement of the monitors a blasting operation is carried out which breaks up the rock body 30. The blast involves some expansion of the rock body and inevitably the rock 30 and the monitors 1 within the rock will be moved from their original position. After the blast the casing 3 within the monitor 1 self rights which causes the transmitter 2 to orientate its generated magnetic field in an upward direction.

An operator with a detector (not shown) then moves over the broken rock and senses the signal from the transmitter. The location of the blast movement monitor 1 is identified by finding the point on the surface of maximum magnetic field strength. Applicant has been able to detect the position of the monitor on an imaginary XY plane extending across the surface of broken rock with an accuracy of less than 1 meter. This post blast position is compared with the original position of the monitor and thus gives a measure of the movement of the rock due to the blast.

The depth of the monitor 1 can be established by further analysis of the magnetic field signals detected by the detector. For example, the strength of the magnetic field at a point broadly above the monitor is a function of the depth of the monitor. Thus by depth calibration of the monitor using experimental data on the particular rock an operator can establish the approximate depth of the monitor in the broken rock. From this the amount of vertical or Z axis movement, if any, of the monitor can be detected. This is important to build up a three dimensional picture of movement of the monitor as a result of the blast. The measure of the depth of the monitor also assists with retrieval of the monitor if required. Applicant has been able to determine the depths of the monitor with a reasonable degree of accuracy.

The depth of the monitor can also be determined by measuring the angle of the magnetic field lines sensed by the detector. This utilizes the principle that the angle at which the magnetic field lines cut the surface of the rock, i.e. their angle to the horizontal, can be used to locate the source of the magnetic field.

In practice an operator locates position the where the detector or receiver registered a null signal. The receiver is then moved away from the null point and the field angle can be measured. This can then be repeated for other distances. The angles and distances from the marker can then be used to determine the depth of the monitor.

The use of the monitors 100 described above on a mine to measure the movement of rock due to blasting and thereby compensate for movement in the ore boundaries will now be described below.

Figure 15:
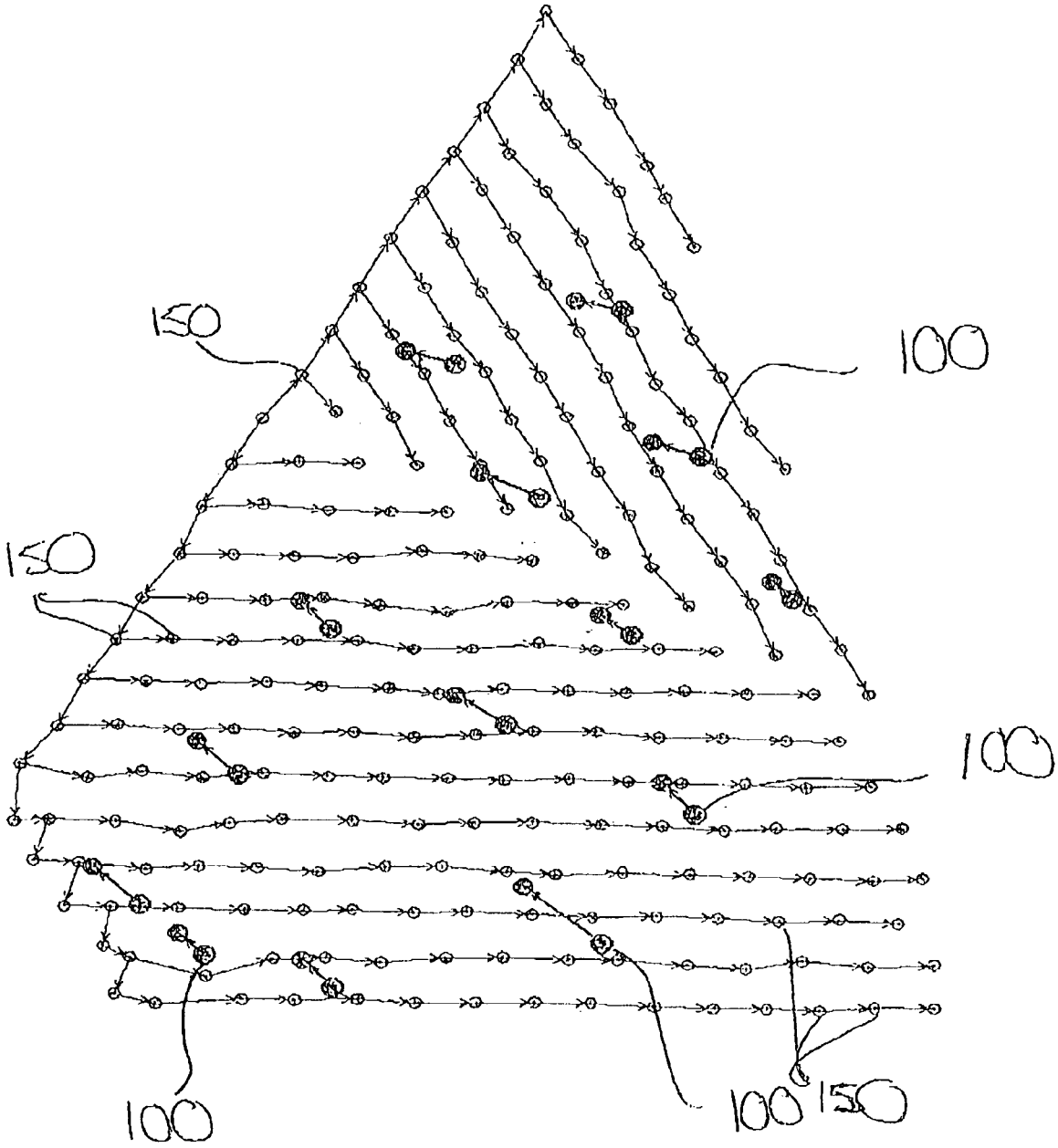
FIG. 15 is a schematic plan view of a blasting site indicating the position of blast holes and also indicating the position of movement monitors amongst the blast holes and also the movement of the monitors as a result of the blasting of the rock body.

A region or batch of a domain of rock to be mined is demarcated. The region is then prepared for blasting by inserting explosives into holes in the rock in a pattern and with a spacing established by blasting experts. An example of such a pattern is illustrated in FIG. 15.

In addition a plurality of blast movement monitors are also placed in holes in the rock. The monitors are spaced apart from each other and are also spaced apart from the blast holes 150. Generally a monitor 1 will be placed about midway between two adjacent blast holes 150. The location of the monitors 1 is chosen by the mining engineer or geologist based on characteristics of the rock body. Generally it is not based on a uniform repeating pattern like the explosive holes. The initial position of the monitors on the region to be blasted is noted.

Thereafter the blasting is carried out and the rock body is broken up into pieces of rock. Overall there is some expansion of the rock body and also considerable movement of the rock within the body.

The position of the monitors after the blast is then established using the hand held detector in the manner described above. The location of the monitors on an imaginary XY plane is obtained by identifying the point of maximum magnetic field strength of the signal transmitted by the monitor. FIG. 15 shows schematically the movement of monitors in one test result due to the blast.

The movement of monitors varied considerably from location to location. The movement of any one monitor would depend on factors such as the strength of the surrounding rock, the proximity to the explosive, the direction of the blast, and the depth of the monitor. These results show that usually one cannot make a reliable assumption about the movement of the rock based on one monitor alone.

The depth of the monitor is also ascertained from the magnetic field signal received by the detector. In broad terms the depth of the monitor is a function of the strength of the magnetic field signal received by the detector. This depth can therefore be determined by depth calibration of the monitors in a particular body of rock.

The movement of the monitors that are seated in the rock is thus representative of the movement of the rock in that region of the rock body. It thus enables the mining engineers and/or geologists to quantify the extent of the rock movement throughout the three dimensional rock body. This information can then be used to adjust the three dimensional picture that the miners have of the boundaries between different ore grade and waste within the rock body to compensate for the rock movement.

The movement of the monitors for example as shown in FIG. 15 is then used to build up an adjusted three dimensional map of the boundaries between the different rock or ore portions.

This result or picture can then be used to predict the adjustment of rock movement to make on similar batches of rock in the same domain. The extent of movement of the rock body can be assumed to be the same for other rock bodies particularly in the same domain and at the same site. Thus it is envisaged that the placement of the blast movement monitors need not be carried out each time a rock body is blasted. They will however be done on a regular basis and will provide a good way to test and/or validate the movement assumptions of the mining engineers.

However where a completely new body of rock is to be mined or the blasting configuration is changed, then the method and apparatus described above can be used to characterize the movement of the rock and to assist engineers to quantify the direction and extend of boundary movement that occurs. Similarly if the performance of the mining operation drops off then one or more movement tests could be conducted to see if the movement assumptions of the rock that are being utilized are correct.

This will then lead to improved reporting of ore to the concentrator and waste rock to the dump.

Open cast coal mining comprises progressively mining a seam of coal positioned underneath a layer of overburden in sections or stages. The stages are mined progressively from one end of the seam to the other. Consequently when a stage is mined one side of the coal is open forming a coal edge and the other is closed off by the contiguous section of coal which is as yet unmined.

Each stage is mined by blasting the overburden by means of a controlled blast with explosives. The blast blows or moves the overburden into the open pit adjacent the coal edge. The displacement of the overburden into the open pit adjacent the coal edge exposes the coal section and thereby enables it to be physically recovered from the mine and sent for beneficiation.

The blast also causes movement of the coal body towards the coal edge. This is the side that has the space to permit expansion as a result of the blast. The movement of the coal edge needs to be measured or quantified so that it can be removed with the rest of the coal. Otherwise it is at risk of being left in the pit adjacent the coal seam. This will lead to a loss of product and will thus be undesirable.

The blast movement monitor as described above with reference to FIG. 14 can be used to measure or quantify the movement of the coal edge. The monitors would be placed in holes in the coal proximate to the coal edge. After blasting the post blast position of the blast movement monitors will be measured using the detector as described above and then the extent of movement of the coal edge into the pit could be ascertained. This provides mining engineers with the information to substantially recover all the coal from that section as coal product.

Experimental Work

The movement monitors described above have been trailed on mining sites to confirm their efficacy and also to measure their reliability.

First Field Trial

A field trial was carried out using the monitor shown in FIG. 2. The objective was to test the suitability of the transmitter and receiver for performing their intended function. All measurements were conducted prior to blasting. The transmitter was lowered into an empty blast hole to a depth of 2 m and the receiver or detector response was noted.

Specifically, the strength of the signal was measured by the detector along two perpendicular scan lines on the surface of the rock. That is the strength of the field was measured along two orthogonal lines in an imaginary XY horizontal plane.

The trial was repeated with the monitor at respectively 4 m and 6 m below the surface.

Figure 6:
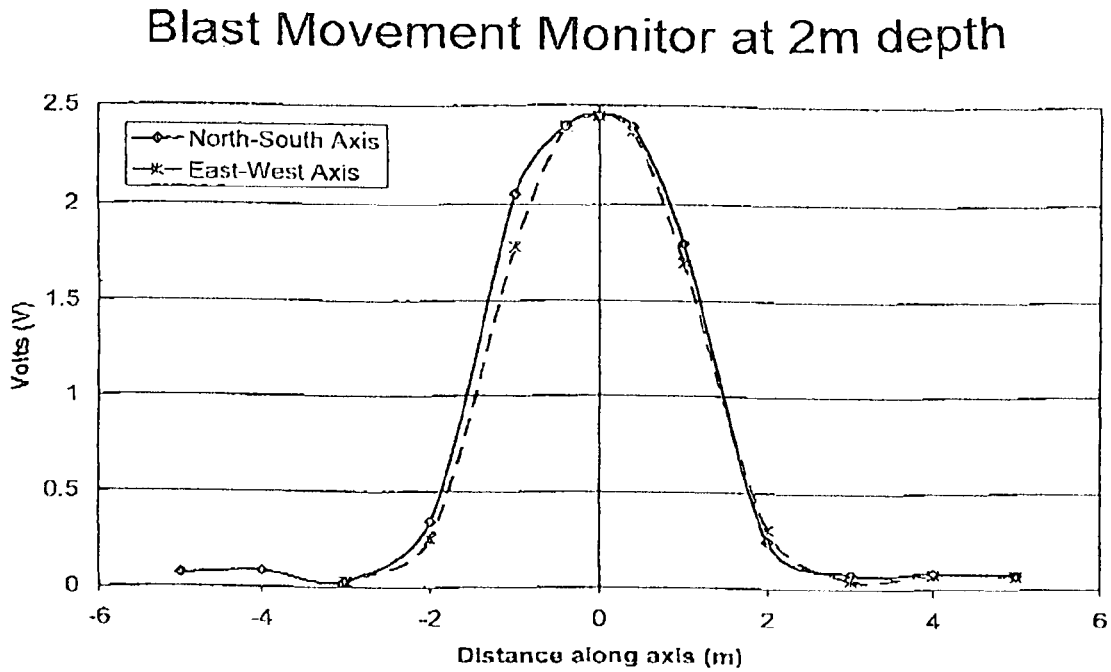
FIGS. 6 to 8 show the strength of the signal measured along respectively north-south and east-west axes centered on a drilled hole in which a monitor was located, the different figures showing the signal when the monitor was at different depths.
Figure 7:
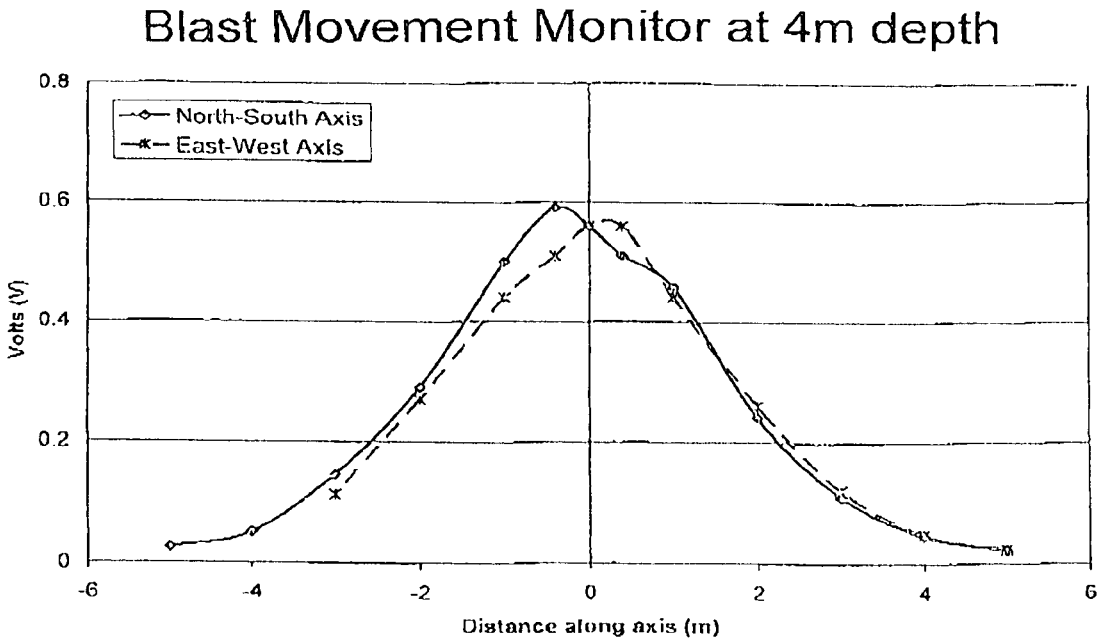
Figure 8:
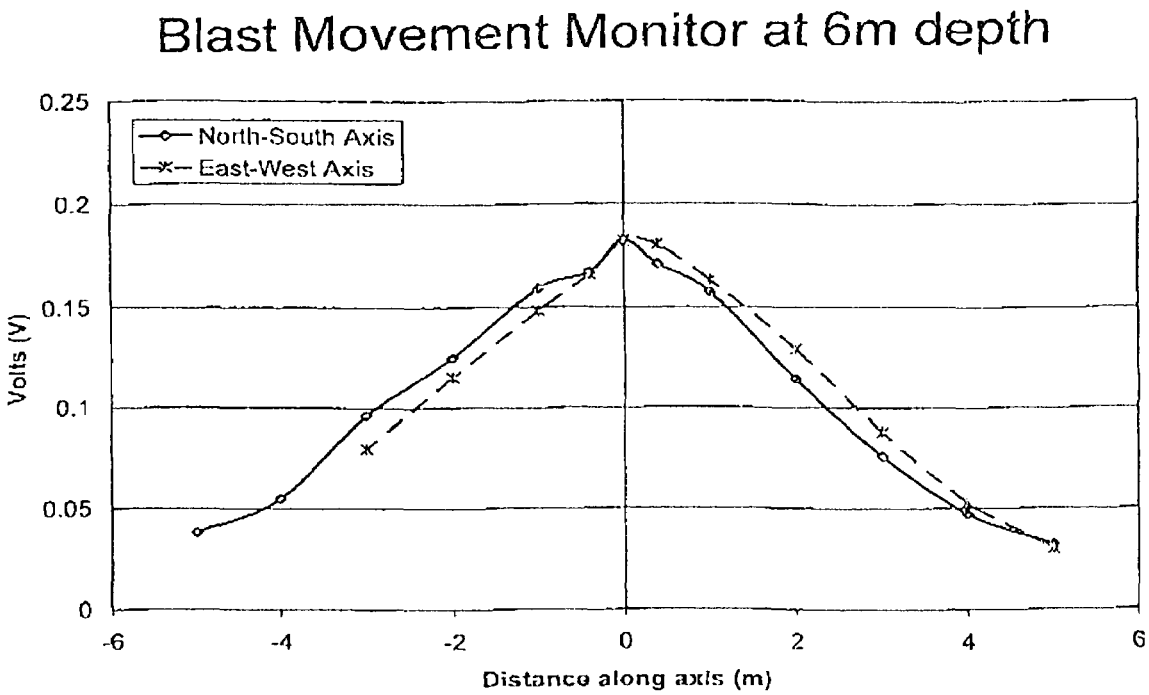

These results are graphically depicted in FIGS. 6 to 8. The results show that the method is reasonably reliable in accurately locating the surface position of the markers. It also shows that the method is accurate up to a depth of up to at least 6 m.

Figure 9:
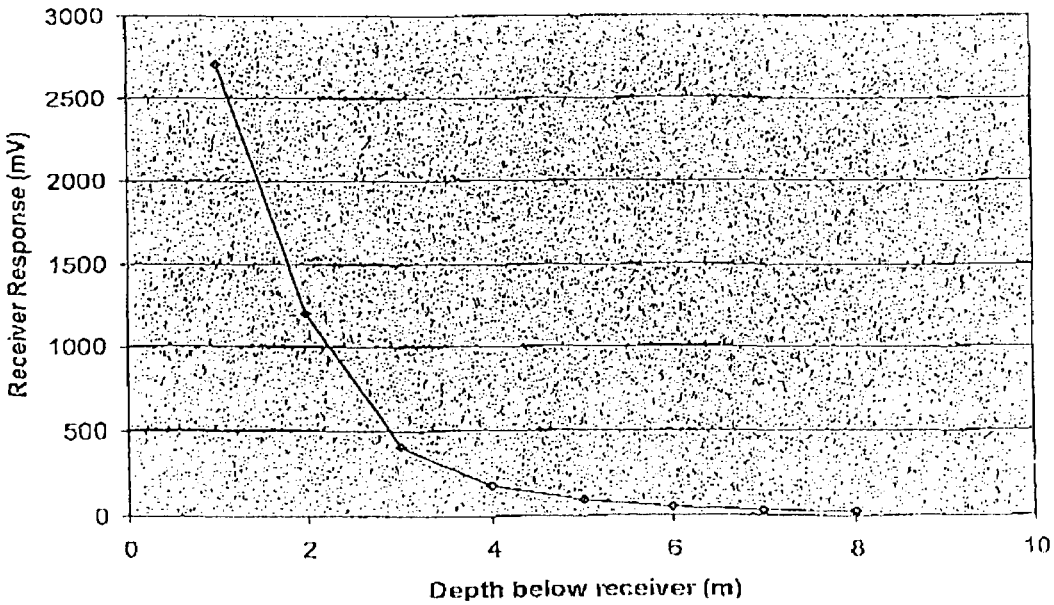
FIG. 9 is a depth calibration graph for the monitor showing the strength of the magnetic signal measured by a detector on the surface as a function of the depth of the monitor within the rock body.

FIG. 9 illustrates the field strength sensed by the detector or receiver as a function of the depth of the receiver below the surface of the rock. This graph shows that there is a significant drop off in field strength from 1 m to 4 m below the surface. Thereafter the rate of drop off with further depth decreases significantly. This result shows that the strength of the signal can be used to measure the depth of the monitor.

Second Field Trial

A second field trial was conducted to assess the ability of the monitor illustrated in FIGS. 10 to 12 to withstand field conditions. Specifically the Applicant wanted to be satisfied that the transmitter and its associated electronic circuitry would be able to withstand the forces generated by the blast.

Two monitors were placed in drill holes during a normal blasting operation at a commercial mine. Blast movement monitors of the type shown in FIG. 2 were fitted with a cover as shown in FIG. 4. The monitors were positioned about midway between their two closest blast holes. The distance between each marker and its nearest blast hole was 5 meters. The markers were placed at a depth of 4 and 5 meters. This depth approximated the depth of the top of the explosive in the nearest blast hole.

The rock body was then blasted in the usual way to break up the rock body into pieces of rock in the usual way.

The location of the monitors was then determined in the following way. The detector was used to measure the strength of the magnetic field signal on a grid centered on the approximate location of the monitors. The detected signal was measured in 1 meter increments on a 7 meter grid or matrix. Thus for each marker there were 49 readings.

Figure 13:
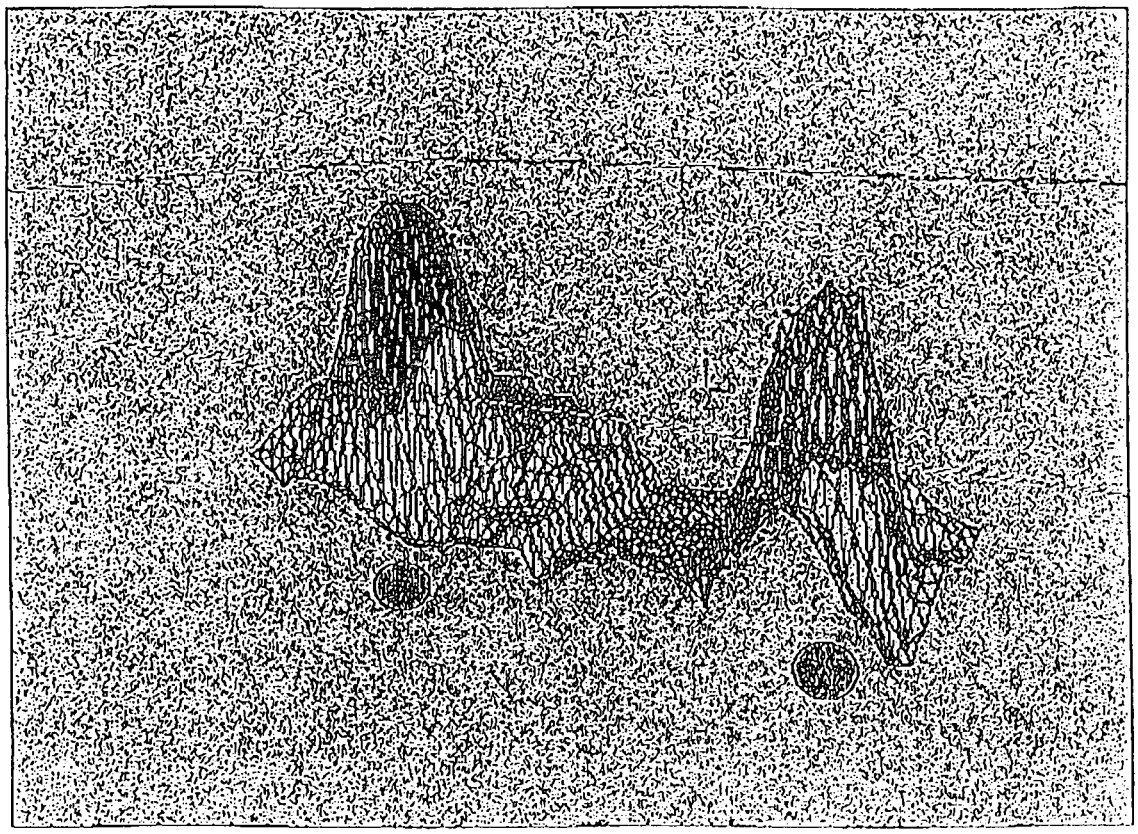
FIG. 13 is a three dimensional map of the strength of the magnetic field sensed by the receiver across the area proximate to the location of two movement monitors.

The results of these field strength readings are graphically illustrated in FIG. 13. It provides a representation of the field strength over the matrix and clearly shows the location of the two markers after the blast.

Further, the monitors were retrieved from the rock to see if they had been damaged by the blast. Generally the monitors had stood up to the blast conditions well and were still working satisfactorily.

Third Field Trial

A third field trial was conducted at the Placer (Granny Smith) Wallaby open pit. This measured the movement of blast movement monitors for a total of 12 blasts. The rock mass for all blasts was very hard with widely spaced joints. The mine environment on which the testing was done was that a 10 m high bench was being mined in two 5 m high slices or flitches, namely a top flitch and bottom flitch. Table 1 summarizes each of the blasts.

The initiation timing was the same for all blasts. The monitors used in this trial were those illustrated in FIG. 14. The monitors were placed directly into the drill hole without a cover.

By comparing the post blast position with the pre blast position the movement of the rock associated with each monitor could be measured. This very quickly showed that the blast caused very substantial movement in the rock.

TABLE 1

Summary of all Blasts

| Date | Blast # | Powder Factor* ($kg/m^3$) | Description of Blast Initiation |
|---|---|---|---|
| 02 Jul. 2003 | 280-40 | 1.17 | Edge blast, reverse echelon |
| 02 Jul. 2003 | 280-41 | 1.17 | "V" Initiated, partial free face at front |
| 22 Aug. 2003 | 270-41 | | Removing Stage 1 ramp |
| 25 Aug. 2003 | 265-05 | 1.50 | Ramp, Drop cut |
| 28 Aug. 2003 | 260-25 | 1.17 | Centre lift, long narrow pattern |
| 31 Aug. 2003 | 260-27 | 1.17 | Edge blast, reverse echelon |
| 02 Sep. 2003 | 260-28 | 1.17 | Edge blast, reverse echelon |
| 06 Sep. 2003 | 260-30 | 1.17 | 'V' Initiated, choked |
| 09 Sep. 2003 | 260-31 | 1.17 | 'V' Initiated, choked |
| 11 Sep. 2003 | 260-32 | 1.17 | 'V' Initiated, choked |
| 15 Sep. 2003 | 260-33 | 1.17 | Double initiated, 2× reverse echelons |
| 19 Sep. 2003 | 260-35 | 1.17 | 'V' Initiated, (partial) choked |

*mass of explosive per cubic meter of rock

The total number of Blast Movement Monitors (BMMs) installed in the 12 blasts was 81. The location of 68 of these monitors was detected after the blast by operators.

Table 2 summarizes the ability of the blast movement monitors to survive the blast conditions. There was a greater loss of monitors from the bottom flitch. It is suspected that most of the monitors that were lost ended up too deep to be detected. The maximum depth at which a monitor was detected was 9.5 m and it does appear that some of the monitors may have ended up deeper than this.

TABLE 2

| Summary of BMM Detection | | | |
|---|---|---|---|
| | Top Flitch | Bottom Flitch | Total |
| Number | 51 | 30 | 81 |
| Detected | 46 | 22 | 68 |
| Percent | 90% | 73% | 84% |

The average horizontal movement of monitors in the bottom flitch was 9.3 m which was approximately twice as great as movement of monitors in the top flitch which was about 4.7 m. The maximum distance by which a monitor was moved was 15.4 m. This observation can be explained by the fact that most of the explosive charge is within the bottom flitch and the energy of the explosive reduces very rapidly with increasing distance from the explosive. Thus its influence on the surrounding rock mass also reduces very rapidly with distance.

Figure 16:
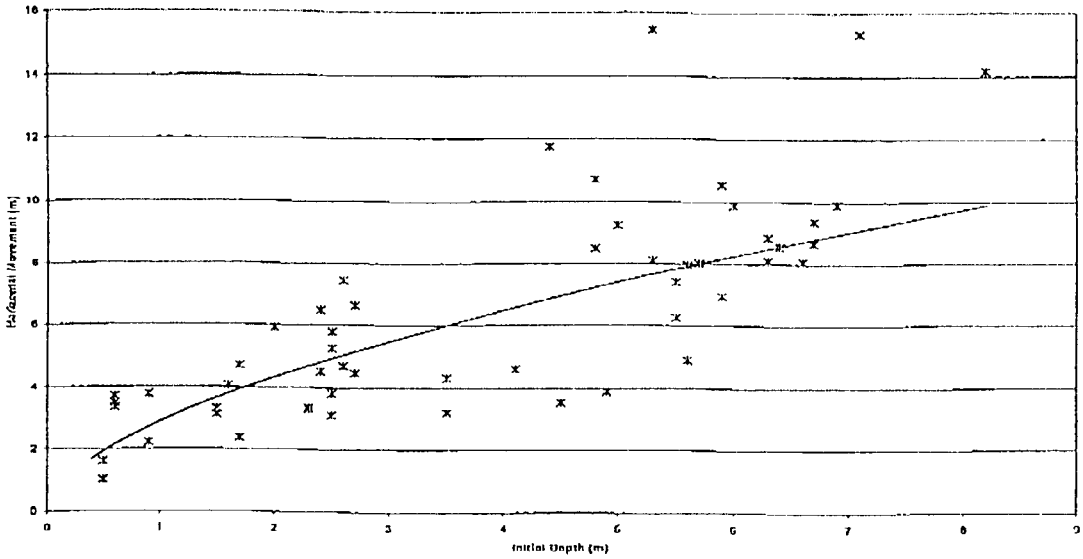
FIG. 16 is a graph showing the correlation of horizontal movement of monitors as a function of the initial depth of the monitors in one of the field trials carried out by the applicant.

FIG. 16 is a histogram of horizontal movement from all tests separated by top and bottom flitch.

The multi-modal nature of the histograms is caused by different regions in the blast—e.g. front, back, edge and body—behaving slightly differently.

Figure 17:
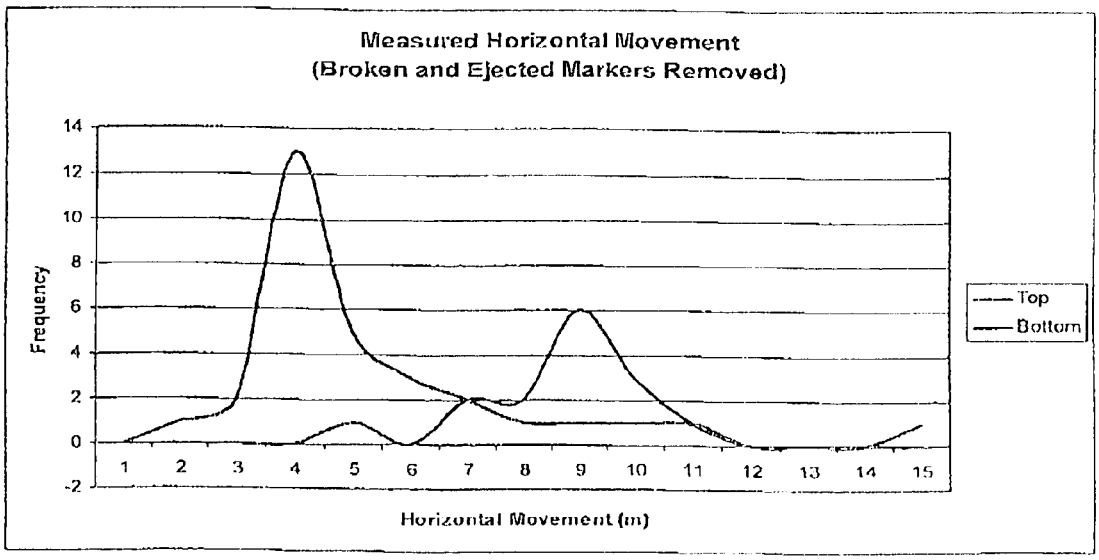
FIG. 17 is a graph showing the most likely movement of monitors in each of top and bottom flitches of a blasted rock body.

FIG. 17 is a graph of horizontal movement plotted against the initial depth of the BMM. Although there is quite a lot of scatter in this data, there is clearly a direct relationship, with movement increasing with depth. The horizontal direction of the movement is typically perpendicular to the blast initiation timing contours.

In these tests the apparatus performed most satisfactorily. In general Applicant found that the monitors were able to withstand the blasting without suffering damage. Specifically the self aligning mechanism proved to be effective at directing the signal upwardly and the transmitters were generally not rendered inoperative by the blast. Further Applicant was often able to locate the position of the monitors with an accuracy of less than 1 metre.

An advantage of the method described above with reference to the drawings is that it can be used to accurately identify the movement of a monitor as a result of blasting and thereby the movement of rock around the monitor. The results can be available within 1-2 hours of the blast. The technique that it uses of transmitting a magnetic field signal from the monitor and then locating the monitor on the basis of the strength of magnetic field has been proved to give accurate and reliable results. Further the self righting feature of the monitor ensures that the transmitter will always transmit its signal vertically upwardly where it will be able to be detected.

A further advantage is that the components of the monitor are not unduly complex. The casing and the housing are fairly simple pieces of hardware. Similarly the transmitter works on fairly simple principles and is assembled from off the shelf equipment. Further as a result of the simplicity of the monitors and the components they contain, the monitors are not unduly expensive to make and use.

It will of course be realized that the above has been given only by way of illustrative example and that all such modifications and variations thereto as would be apparent to persons skilled in the art are deemed to fall within the broad scope and ambit of the claims as is herein set forth

The invention claimed is:

1. A method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting, wherein the signal that is measured is a magnetic field component of an electro-magnetic field and the frequency of the signal is in the range of 10-200 kHz.

2. A method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting, wherein the signal is a low frequency signal in the range of 20-100 kHz.

3. A method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting, wherein the movement monitor includes a transmitter for transmitting the signal and wherein the external communication device includes a detector for detecting the signal from the transmitter, wherein the detector senses a magnetic component of an electro-magnetic field generated by the transmitter and the strength of the magnetic field.

4. A method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting, wherein the movement monitor includes a transmitter for transmitting the signal and wherein the external communication device includes a detector for detecting the signal from the transmitter, wherein each movement monitor has means for enabling the transmitter to orientate in a certain direction after the blast so that all monitors are consistent in the direction in which they emit their signal.

5. A method according to claim 4, wherein the orientating means comprises self-righting means wherein the transmitter in each monitor is able to return to an upright position after the blast so as to transmit its signal in a substantially vertically upward direction.

6. A method according to claim 5, wherein the transmitter is received within a casing which in turn is housed within a housing with the casing being movable relative to the housing, and wherein the self-righting means comprises forming the casing and transmitter with an asymmetric weight distribution with a center of mass positioned directly beneath the center of the monitor so as to cause the monitor to revert to its upright position if it is disturbed during the mining operation.

7. A method for determining the movement of a blast movement monitor placed within a body of rock as a result of blasting of the rock, the method comprising:

placing at least one movement monitor in the rock body and noting its position;

blasting the rock body to break up the rock body into a plurality of rock pieces; and locating the position of at least one placed movement monitor by analyzing a signal passed between the monitor and an external communication device to determine the post blast position of the monitor at least in a plane parallel to the ground;

whereby to measure the movement of the monitor/s by comparison of pre and post blast positions as a result of the blasting, wherein the external communication device is used to locate the XY position of the monitor relative to the surface of the broken rock by locating a point on the surface of the broken rock where a magnetic field signal associated with the monitor is at its greatest.

8. A method according to claim 7, wherein the vertical depth of the monitor within the broken rock is gauged by measuring the strength of the magnetic field signal associated with the monitor at the point on the surface of the broken rock where the magnetic field signal is at its greatest.

9. A method according to claim 7, wherein the vertical depth of the monitor within the broken rock can be gauged by measuring the angle of the magnetic field sensed by the external communication device.

10. A method of determining the movement of boundaries between different portions of a heterogeneous rock body as a result of a blast, the method comprising the following steps:

placing at least one blast movement monitor including a monitor body defining an interior space. an internal communicating device that is received within the interior space of said monitor body for either transmitting a signal outwardly to an external communication device or being able to detect a signal transmitted inwardly by an external communication device, and a housing having an inner surface defining an interior chamber within which the monitor body is received, the monitor body being capable of movement relative to said housing within said housing, in the rock body prior to blasting and noting the position of the or each blast movement monitor;

blasting the rock body to break up the rock body into a plurality of rock pieces;

locating the position of at least one blast movement monitor as a result of the blast;

determining the movement of the rock in the region of the at least one blast movement monitor due to the blast; and adjusting the position of the boundaries between different rock portions in response to the determined movement of rock to compensate for movement caused by the blast.

11. A method according to claim 10, including locating the position of at least 75% of the blast movement monitors as a result of the blast.

12. A method according to claim 10, wherein the boundaries of the rock body delineate rock portions that are sulphide ores, oxide ores and/or supergene ores.

13. A method according to claim 10, wherein at least some of the blast movement monitors are placed in positions in the rock body that are on or are proximate to a boundary between different rock portions within the rock body.

14. A method according to claim 10, wherein the method further includes building up an adjusted three dimensional map of the boundaries of the different rock portions based on the movement of the blast movement monitors as a result of the blast.

15. A method according to claim 10, further including the step of providing a map of the boundaries of the different rock portions within the rock body prior to said step of adjusting the position of the boundaries.

16. A method according to claim 10, comprising placing a plurality of blast movement monitors in spaced holes in the rock body.

17. A method according to claim 16, wherein the spaced holes that receive the blast movement monitors are spaced away from explosives holes.

18. A method according to claim 10, wherein the step of adjusting the position of the boundaries between the rock portions includes adjusting each said boundary based on a distance weighted average movement of one or more monitors as a result of the blast.

19. A method according to claim 18, wherein the step of adjusting the position of the boundaries between the rock portions is based on movement of a plurality of monitors located on the boundary or in proximity to the boundary.

20. A method according to claim 10, wherein the boundaries of the rock body delineate rock portions that are high grade ore, low grade ore and waste.

21. A method according to claim 20, wherein the high grade ore comprises polygons of gold ore having a grade of about 5-7 g/t and the low grade ore comprises polygons of gold ore having a grade of about 1-3 g/t that need to be recovered separately from the high grade ore.

22. A method according to claim 10, wherein the boundaries of the rock body delineate rock portions that are a recoverable ore polygon and waste.

23. A method according to claim 22, wherein the rock body comprises a rock portion that is a polygon of high grade gold ore received within a large body of host waste rock.

* * * * *

UNITED STATES PATENT AND TRADEMARK OFFICE

CERTIFICATE OF CORRECTION

PATENT NO. : 7,490,507 B2
APPLICATION NO. : 11/601283
DATED : February 17, 2009
INVENTOR(S) : La Rosa et al.

It is certified that error appears in the above-identified patent and that said Letters Patent is hereby corrected as shown below:

Title page:

After section (62) insert:

--(60) Provisional application No. 60/531,534, filed on Dec. 19, 2003.--

Signed and Sealed this

Eighth Day of September, 2009

David J. Kappos

David J. Kappos
*Director of the United States Patent and Trademark Office*